US005222837A

United States Patent [19]

Phillips

[11] Patent Number: 5,222,837

[45] Date of Patent: Jun. 29, 1993

[54] MINE ROOF CHANNEL CLAMP

[76] Inventor: Connie L. Phillips, Box 385, Waynesburg, Pa. 15370

[21] Appl. No.: 810,194

[22] Filed: Dec. 19, 1991

[51] Int. Cl.[5] ..... E21D 11/15

[52] U.S. Cl. ..... 405/288; 248/72; 405/150.1; 405/302.1

[58] Field of Search ..... 405/132, 150.1, 259.1, 405/288, 302.1; 248/49, 62, 63, 72, 73, 74.1

[56] References Cited

U.S. PATENT DOCUMENTS

| | | | |
|---|---|---|---|
| 1,797,214 | 3/1931 | Mayer et al. | 248/72 X |
| 2,398,130 | 4/1946 | Beijl | 405/259.1 |
| 2,749,068 | 6/1956 | Wayman | 248/72 |
| 2,854,824 | 10/1958 | Curry et al. | 405/302.1 |
| 4,114,846 | 9/1978 | Petersen | 248/73 X |

*Primary Examiner*—David H. Corbin
*Attorney, Agent, or Firm*—William J. Ruano

[57] ABSTRACT

A clamp for clamping attachment to a mine roof channel, which clamp has a pair of top portions and a pair of bottom portions for engaging the top and bottom, respectively, of the mine roof channel. A bolt, such as an eye-bolt, has a threaded portion extending between the top and bottom portions of the clamp forming a component part of the clamp. Such threaded portion, in one modification of the clamp, engages the bottom central portion of the mine roof channel. Loads such as wires, hoses etc. may be supported by the eye of eye-bolt so as to be adjustably positioned close to the sidewalls of the mine.

5 Claims, 2 Drawing Sheets

MINE ROOF CHANNEL CLAMP

This invention relates to a mine roof channel clamp for supporting eye-bolts or roof bolts which, in turn, support ventilating tubes, cables and the like.

BACKGROUND OF THE INVENTION

In the past, items, such as ventilating tubing and cables, have been supported by makeshift means, such as spads and other fasteners driven into the roof or sidewall of the mine and, as the result of which it has not been possible to provide secure support and sufficient clearance along the sidewalls and often, such tubing and cables would collide with the head of the miner.

SUMMARY OF THE INVENTION

An object of the invention is to provide a novel clamp and eye-bolt or roof bolt forming a component part of the mine roof channel to enable secure suspension, by the eye-bolts or roof bolts, of ventilation tubes, cables and the like, which run along the length of the mine sidewalls.

DESCRIPTION OF THE PREFERRED EMBODIMENTS

Figure 1:
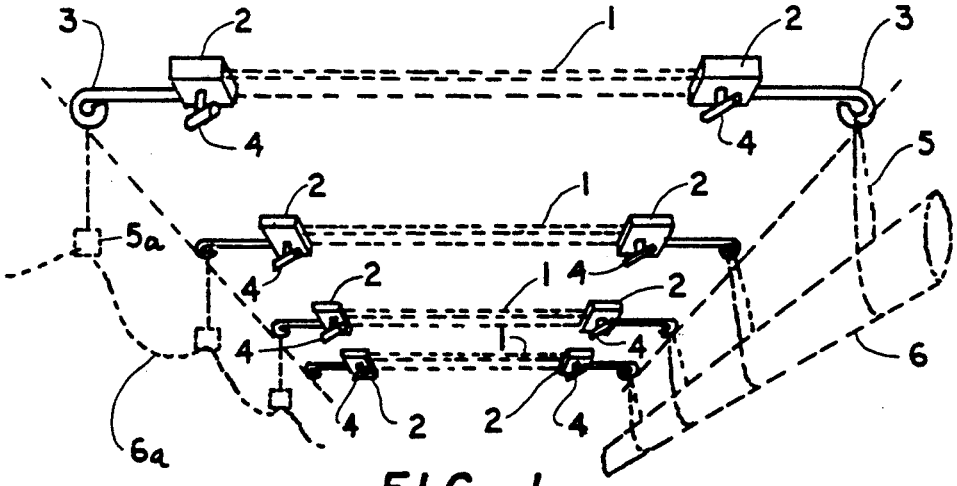
FIG. 1 is a perspective view, as viewed by the miner, of the mine roof channel, shown dotted, provided with clamps embodying the present invention.

Referring to FIG. 1, numeral 1 denotes a conventional mine roof channel which is formly attached to a mine roof (not shown). It takes two forms, either the one shown in FIG. 4 denoted by numeral 1, or the same channel inverted so as to assume the shape of the mine channel 1*a* shown in FIG. 8.

Figure 2:
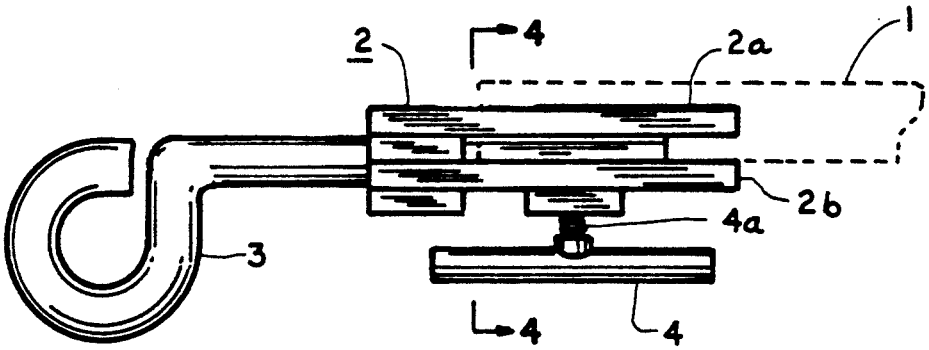
FIG. 2 is an enlarged side view of one of the clamps supporting an eye-bolt.
Figure 3:
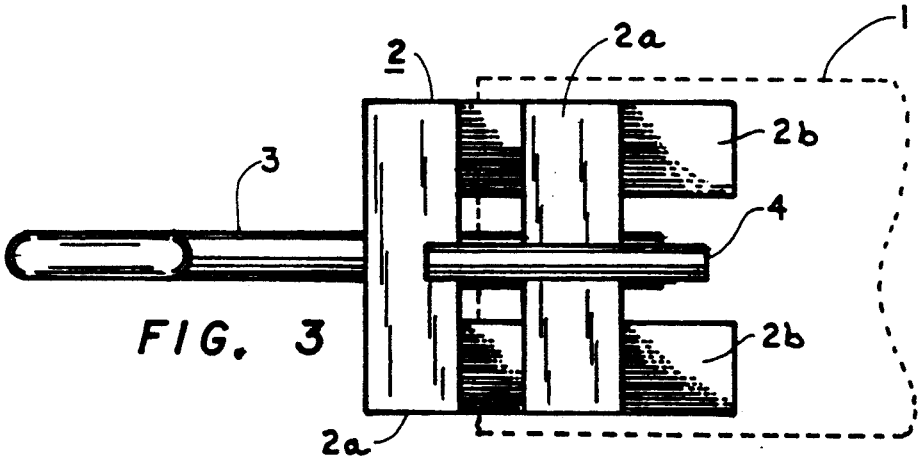
FIG. 3 is a bottom view of the clamp shown in FIG. 2.
Figure 4:
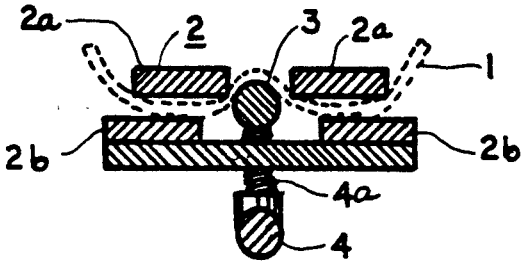
FIG. 4 is a cross-sectional view taken along line 4—4 of FIG. 2 illustrating one form of the mine roof channel 1.
Figure 5:
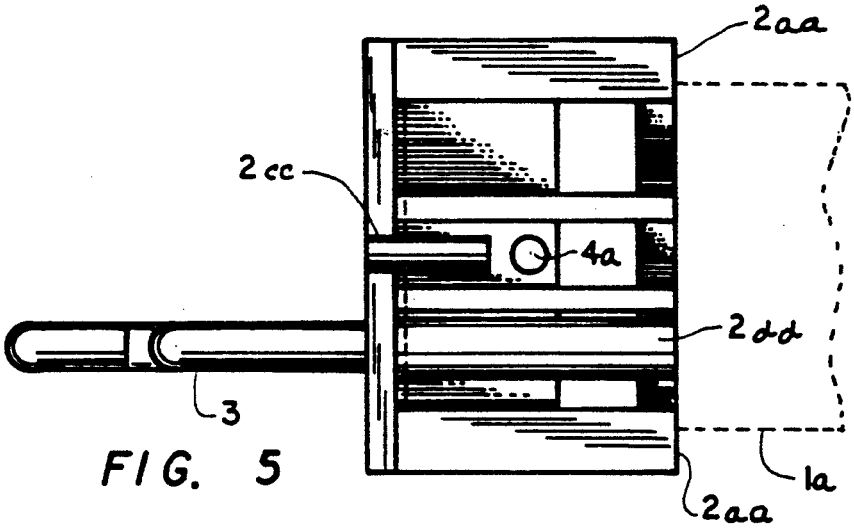
FIG. 5 is a top view of a modified form of clamp for attachment to the same mine roof channel 1 when inverted, as shown in FIG. 8 and denoted 1*a*.
Figure 6:
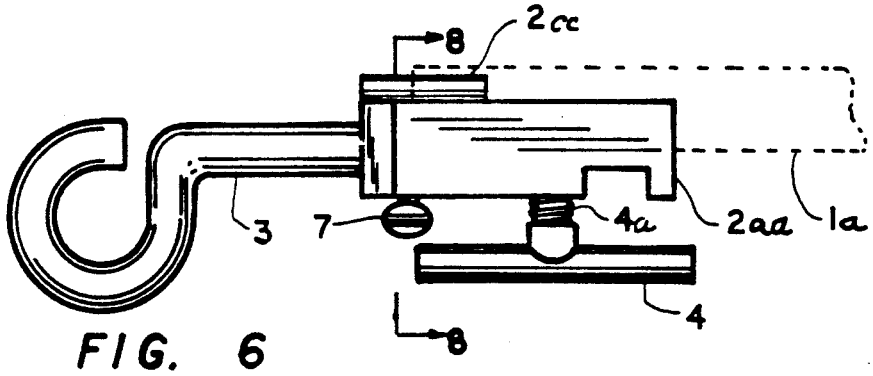
FIG. 6 is a side view of the clamp shown in FIG. 5.
Figure 7:
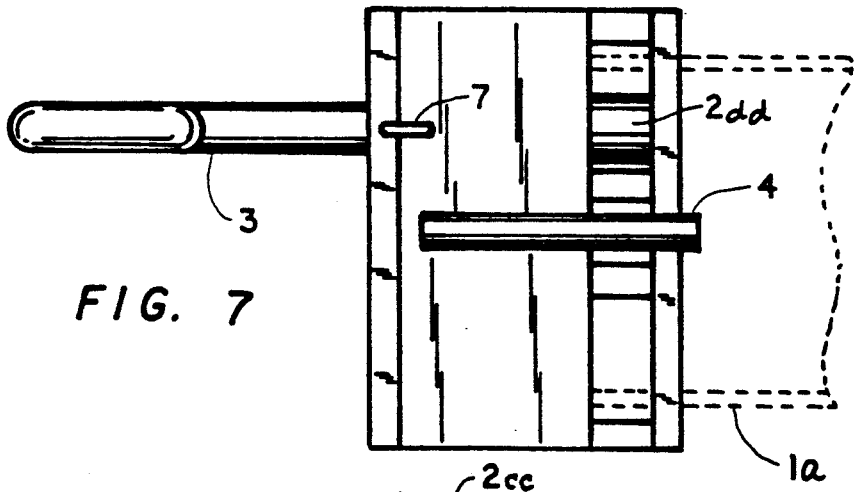
FIG. 7 is a bottom view of the clamp shown in FIG. 6.

Referring to FIGS. 2 and 3, which show a clamp for clamping onto a mine channel 1 as shown in FIG. 4, numeral 2 generally denotes the entire clamp assembly comprising upper spaced parts or slabs 2*a* which are integrally attached to laterally offset lower spaced parts 2*b*, 2*b*, as more clearly shown in FIG. 4.

Eye-bolt 3 has a shank threaded portion extending into mine roof clamp 1, as shown in FIG. 4, whereas the confronting surfaces of the mine roof clamp 2 engage the upper and lower surfaces of the mine roof channel 1, as more clearly shown in FIG. 4. A screw handle 4 extending underneath the clamp has a threaded portion 4*a* which engages a lower surface of the threaded portion of the eye-bolt 3.

Figure 8:
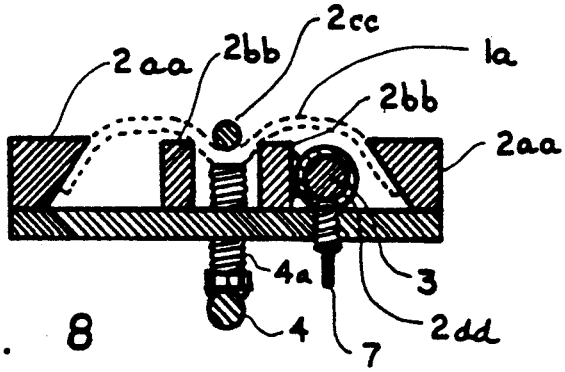
FIG. 8 is a cross-sectional view taken along line 8—8 of FIG. 6.

FIGS. 5 to 8 inclusive, show a modified construction of clamp suitable for clamping to the mine roof channel 1*a* in an inverted position (FIG. 8) as compared to FIG. 4. In this case, the clamp has integral parts welded together such as 2*aa*, 2*bb*, 2*cc* and 2*dd* welded to a common base. As shown in FIG. 8, portions 2*aa*, 2*aa* are slanted on their inner surfaces so as to rest on top of the extremities of the mine roof channel 1*a*. Parts 2*bb* rest against the bottom of the mine roof channel 1*a*. The screw handle 4 has a threaded portion which engages the lower central portion of the mine roof channel 1*a*. The threaded shank of eye-bolt 3 extends through cylindrical sleeve 2*dd* which is welded to part 2*bb*. Thumb screw 7 clamps the threaded shank to the common base in the desired extended position.

A unique feature of the modifications shown in FIGS. 1–4 and FIGS. 5–8 is that in both, the threaded shank of the eye-bolt 3 forms a component part of the clamp. Also the eye of the eye-bolt 3 may be adjustably extended towards the sidewalls of the mine. Thus the cable hangers 5 (FIG. 1) may be moved very close to the sidewall of the mine so as to support tube 6 adjacent the sidewall, which tube may contain hoses, wires etc. Likewise, hangers such as 5*a* may carry similar items 6*a* extending through their openings. Thus the heavy weights of such hoses and wires are borne completely by the mine roof channel 1 or 1*a*. Thus ample work space is provided along the sidewalls.

While I have illustrated and described several embodiments of my invention, it will be understood that these are by way of illustration only and that various changes and modifications are contemplated in my invention within the scope of the following claims:

I claim:

1. In combination with an end of a mine roof strip of sinuous cross-section, which strip extends across the width of the mine roof, said cross-section comprising a crest portion and two well portions, an open eye-bolt serving as a hanger having a horizontally extending shank; two pairs of clamps, each pair clamping opposite sides of said two well portions, a base integrally supporting at least one of said pairs of clamps, and manually operated screw means for securing said base to said horizontally extending shank.

2. The combination recited in claim 1 wherein said screw means includes a screw handle having a threaded portion screwed through said base, which threaded portion include an end which engages the outer surface of said crest portion, and stationary means integrally secured to one of said pairs of clamps for supporting the inner surface of said crest portion.

3. In combination with an end of a mine roof channel of sinuous cross-section extending across the width of a mine roof, a clamp having a base and a pair of laterally spaced top engaging portions and a pair of laterally spaced bottom engaging channel portions laterally offset from said top engaging portions, and a screw handle having an integrally threaded shank screw threaded to said base for exerting pressure against the bottom central portion of said mine roof channel for tightly clamping said clamp to said mine roof channel, together with an eye bolt having a threaded shank portion extending between said top and bottom engaging portions and having an eye portion extending beyond the end of said clamp.

4. The combination recited in claim 3 wherein said threaded shank of said eye-bolt directly engages the bottom central portion of said mine roof channel.

5. The combination recited in claim 4 together with a cylindrical sleeve integrally secured on said base and through which the threaded shank portion of said eye bolt extends, and a thumb screw for clamping said clamp against said threaded shank portion.

* * * * *